US009814955B2

(12) United States Patent
Bonfigli

(10) Patent No.: US 9,814,955 B2
(45) Date of Patent: Nov. 14, 2017

(54) ADJUSTABLE SPORTS PADDLE

(71) Applicant: Mark Bonfigli, Shelburne, VT (US)

(72) Inventor: Mark Bonfigli, Shelburne, VT (US)

( * ) Notice: Subject to any disclaimer, the term of this patent is extended or adjusted under 35 U.S.C. 154(b) by 6 days.

(21) Appl. No.: 14/715,276

(22) Filed: May 18, 2015

(65) Prior Publication Data

US 2016/0339312 A1 Nov. 24, 2016

(51) Int. Cl.

| | |
|---|---|
| ***A63B 60/28*** | (2015.01) |
| ***A63B 60/50*** | (2015.01) |
| ***A63B 59/48*** | (2015.01) |
| ***A63B 60/42*** | (2015.01) |
| ***A63B 71/06*** | (2006.01) |
| ***A63B 60/46*** | (2015.01) |
| ***A63B 102/08*** | (2015.01) |
| ***A63B 59/42*** | (2015.01) |
| ***A63B 60/06*** | (2015.01) |
| ***A63B 60/16*** | (2015.01) |

(52) U.S. Cl.

CPC ..... *A63B 60/28* (2015.10); *A63B 59/48* (2015.10); *A63B 60/42* (2015.10); *A63B 60/50* (2015.10); *A63B 59/42* (2015.10); *A63B 60/06* (2015.10); *A63B 60/16* (2015.10); *A63B 60/46* (2015.10); *A63B 71/0622* (2013.01); *A63B 2071/0694* (2013.01); *A63B 2102/08* (2015.10); *A63B 2220/56* (2013.01); *A63B 2225/62* (2013.01)

(58) Field of Classification Search

CPC ..... A63B 59/00

See application file for complete search history.

(56) References Cited

U.S. PATENT DOCUMENTS

| | | | | |
|---|---|---|---|---|
| 1,026,990 A | | 5/1912 | Matson | |
| 2,987,317 A | | 6/1961 | Acevedo | |
| 3,162,443 A | * | 12/1964 | Petri | A63B 59/80 273/DIG. 8 |
| 4,189,142 A | * | 2/1980 | de Vries | A63B 51/06 473/542 |
| 4,206,917 A | | 6/1980 | Guillem et al. | |
| 4,635,936 A | | 1/1987 | Becker et al. | |
| 5,904,628 A | * | 5/1999 | MacKay, Jr. | A63B 53/00 473/300 |
| 6,053,827 A | * | 4/2000 | MacKay, Jr. | A63B 59/50 473/566 |

(Continued)

FOREIGN PATENT DOCUMENTS

EP 2044982 A1 4/2009

OTHER PUBLICATIONS

PCT /US2015/044678, IFD: Aug. 11, 2015—International Search Report, dated Nov. 6, 2015.

*Primary Examiner* — Gene Kim
*Assistant Examiner* — Jeffrey Vanderveen
(74) *Attorney, Agent, or Firm* — Fulwider Patton LLP

(57) ABSTRACT

An adjustable sports paddle including a handle that extends to a neck portion and a substantially ovular frame. The frame supports first and second striking surfaces, which are sandwiched about an inflatable bladder. A conduit extends from the bladder to the handle through the neck, and the handle further includes a pressurizing mechanism for increasing an air pressure in the bladder via the conduit. In a preferred embodiment, the paddle can also include an adjustable handle having multiple lengths.

14 Claims, 8 Drawing Sheets

(56) References Cited

U.S. PATENT DOCUMENTS

| | | | | |
|---|---|---|---|---|
| 6,213,902 | B1 * | 4/2001 | Hagey | A63B 49/08 473/549 |
| 7,458,270 | B2 | 12/2008 | Kiefer et al. | |
| 8,663,026 | B2 * | 3/2014 | Blowers | A63B 53/0466 473/326 |
| 2011/0201461 | A1 * | 8/2011 | Gazzara | A63B 59/48 473/527 |

* cited by examiner

ADJUSTABLE SPORTS PADDLE

BACKGROUND

Beach paddle ball, or "Matkot," is a growing beach pastime that is increasing in popularity. It is believed that the game originated along the Mediterranean Sea, and has migrated to the United States and is played throughout the country. Beach paddle ball is played with multiple players, typically two to three participants, where a small rubber ball is volleyed back and forth between the players using a wooden paddle. The broad wooden paddle or racket is called a matka—for which the game is named—and the object of the game is for the players to hit the ball back and forth in an effort to keep it from hitting the sand.

Sports paddles and racquets such as that used in Matkot are ubiquitous and come in a wide variety of shapes, sizes, and designs. For example, ping pong is played with a wooden paddle that includes a rubber or tacky sheet adhered to the surface of the wooden paddle, whereas squash, tennis, and badminton racquets use a wooden, metal, or composite frame with strings across the surface to form a hitting area. There are also hybrids of these games, including beach tennis, table tennis, and so forth, each using a different type of paddle or racquet. In each of these games and activities, a specialized sports paddle is used to hit a ball of some kind to or in a designated playing area. The performance of the sports paddle is dependent upon the purpose of the game and the design of the paddle, but once a paddle is designed it is typically fixed in terms of response, performance, size, etc. There is no effective way to adjust, for example, a ping pong paddle to select a different response as might be advantageous for playing a two different opponents. Similarly, wind conditions, the skill level of the participants, and desire for greater control versus power (or vice versa) would make it advantageous for paddles such as a beach paddle ball paddle to have some adjustability over the response. In other circumstances, it may be preferably to extend the handle to accommodate different players, playing conditions, etc. The present invention is directed to this goal.

SUMMARY OF THE INVENTION

The present invention is a multipurpose sports paddle that can be used for a myriad of games and activities, and provides a new flexibility and control over the response of the paddle that is heretofore unavailable. The paddle incorporates an internal inflatable member, such as an air filled bladder, that modifies the coefficient of restitution ("COR") of the paddle when hitting another object such as a ball. In this application, the coefficient of restitution for a one dimensional (linear) collision is defined to be the ratio of the velocity of separation (post impact velocity) to the velocity of approach (pre impact velocity). The paddle of the present invention includes a manually operated pump mechanism in the handle that forces compressed air into the inflatable bladder, which in turn changes the COR of the paddle. A valve can be released to allow air to escape the bladder to also alter the COR, and a preferred embodiment of the invention includes a visual indicator to show where the current air pressure is as compared with a maximum design pressure. By adjusting the pressure in the bladder, a player can alter the response (i.e., COR) of the sports paddle for greater elasticity in the collision with the ball/objection, increasing the flexibility and enjoyment of the sports paddle.

In a preferred embodiment, the paddle of the present invention can also be shortened or extended in a quick, reliable manner by adding or removing stackable elements at the end of the handle as desired by the player. The stackable elements lengthen the handle incrementally so that the desired handle can be achieved by the player, adding to the versatility of the paddle.

These and other features of the invention will best be understood in view of the descriptions below in conjunction with the associated drawings.

DETAILED DESCRIPTION OF THE PREFERRED EMBODIMENTS

Figure 1:
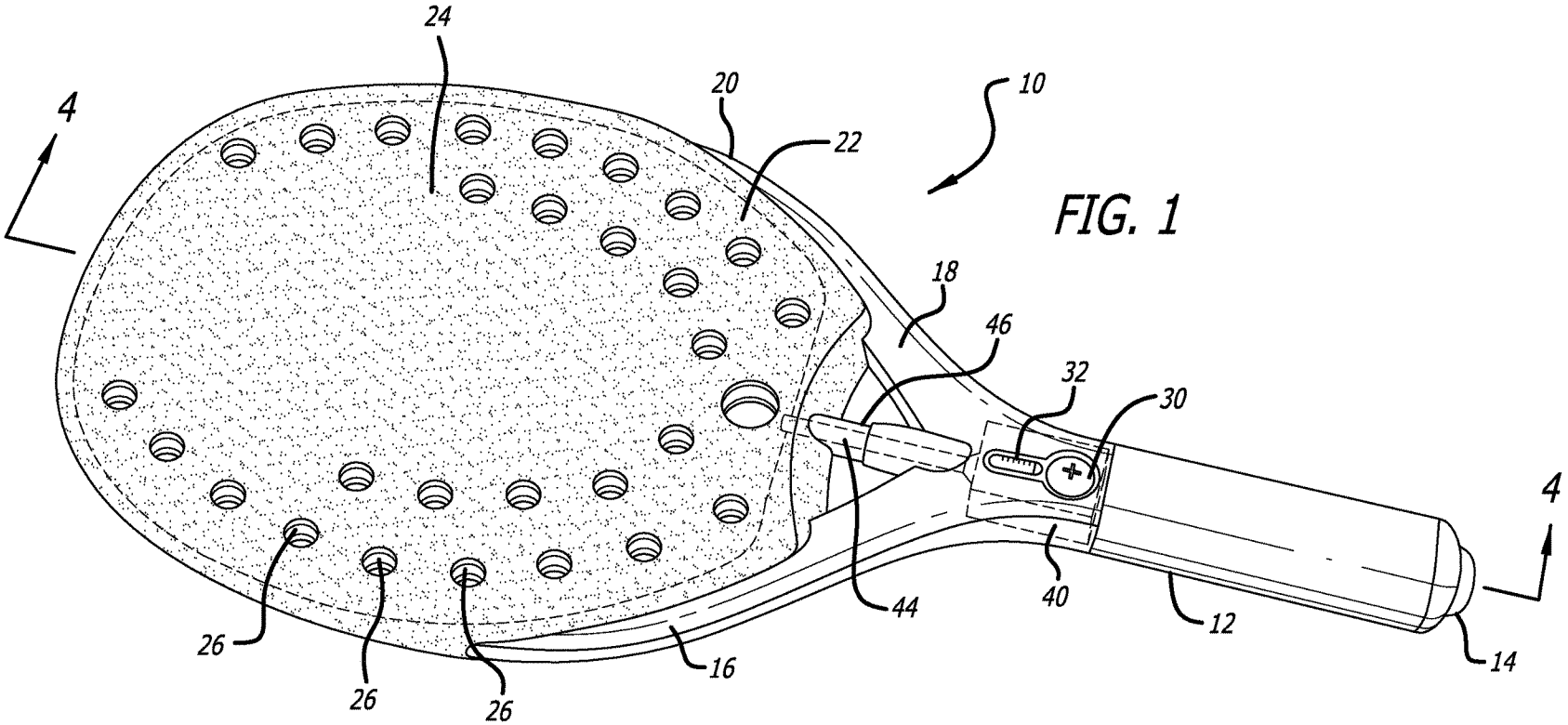
FIG. 1 is an elevated, perspective view of a first embodiment of the present invention.
Figure 2:
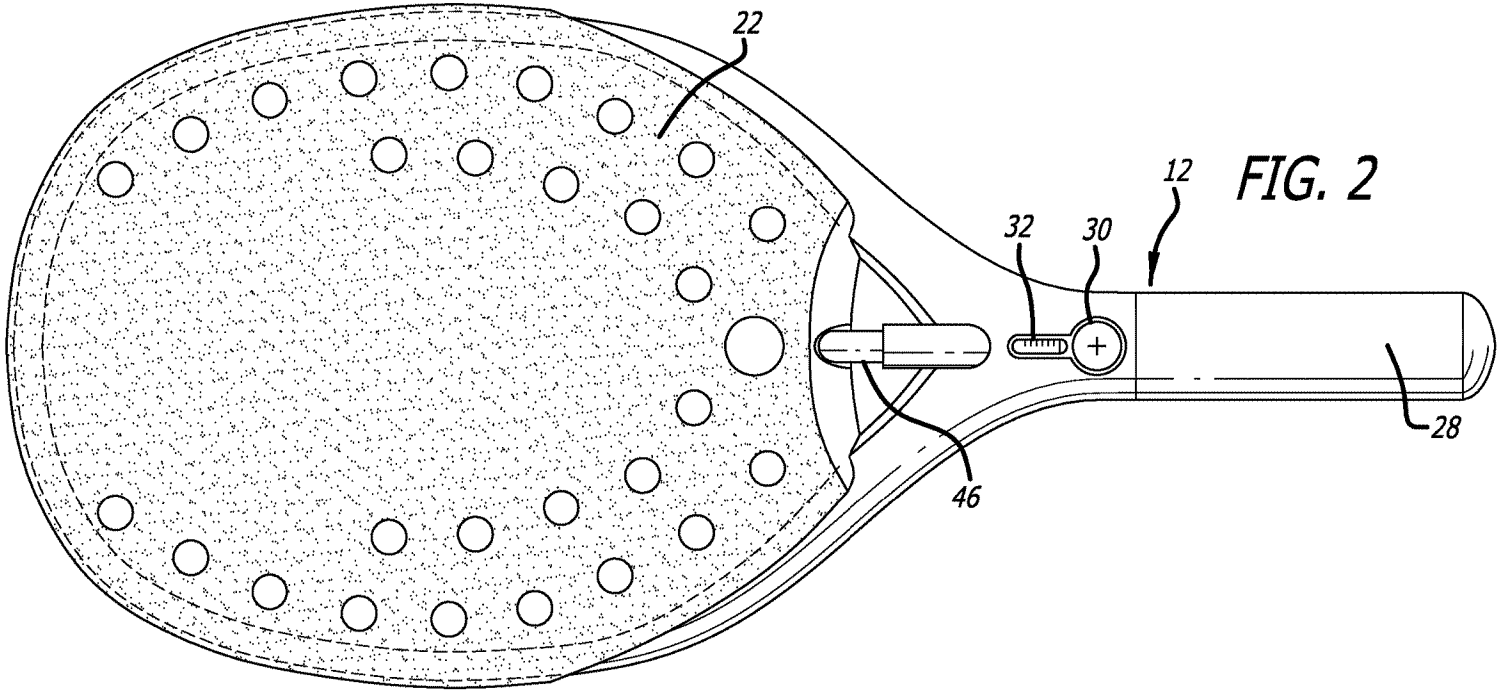
FIG. 2 is a top view of the embodiment of FIG. 1.
Figure 3:
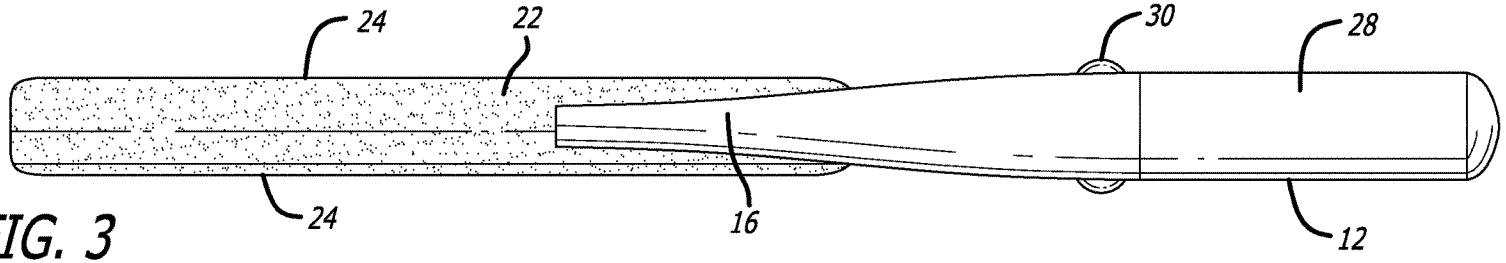
FIG. 3 is a side view of the embodiment of FIG. 1.

FIGS. 1-3 illustrate a first preferred embodiment of the present invention depicting a sports paddle 10 used for various activities and games, including beach paddle ball as well as ping pong, and the like. The paddle 10 includes a handle 12 that may have a foam grip cover, a tacky cloth or tape wrap, or other friction enhancing surface to promote satisfactory gripping. The handle may preferably include an emblem, logo, or insignia 14 on the bottom to advance brand recognition. The handle 12 is connected to a support structure 16 that comprises a neck 18 and a substantially ovular frame 20. The substantially ovular frame 20 is used to mount a molded insert 22 having first and second striking surfaces 24. The molded insert 22 is preferably made from a resilient plastic or thermoplastic, formed to fit into the ovular frame 20. The molded insert 22 includes a hitting zone in the center of the frame 20, and in some applications a plurality of holes 26 arranged around the perimeter of the insert. The holes permit air to easily pass through and allow the paddle to be swung more freely and easily. Air can also pass through the neck portion 18. The presence and number of holes 26 can vary depending upon the application and preference of the player.

On the handle 12 positioned above the grip 28 is a bellows 30 or pump device, and a sight glass 32 or optical gauge. The bellows 30 may be a flexible dome-shaped structure that can be manually depressed by the player. The bellows 30 once depressed and released, returns to its original shape so that it can be pumped repeatedly. The sight glass 32 can include an indicator that shows a relative internal gas pressure in a compartment below the gauge, where the gas pressure is increased by repeated depressions of the bellows 30. The player can observe the increase in pressure by using the sight glass 32, and compare the internal gas pressure to a maximum recommended design pressure on the gauge. The internal gas pressure can also be indicated in other ways, including a dial, LED, diaphragm, pressure sensor, or similar devices.

Figure 4:
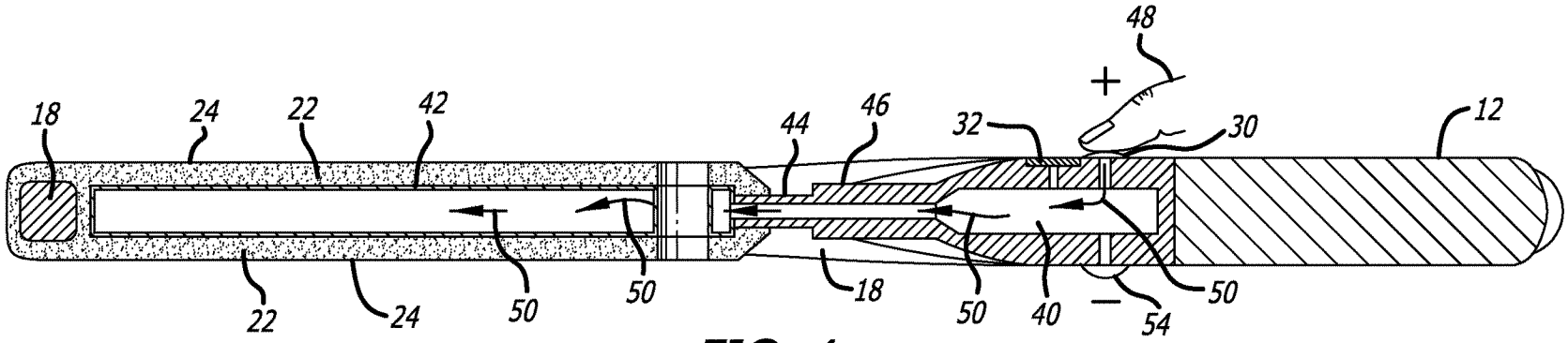
FIG. 4 is a cross sectional view along lines 4-4 of the embodiment of FIG. 1 showing inflation of the bladder.
Figure 5:
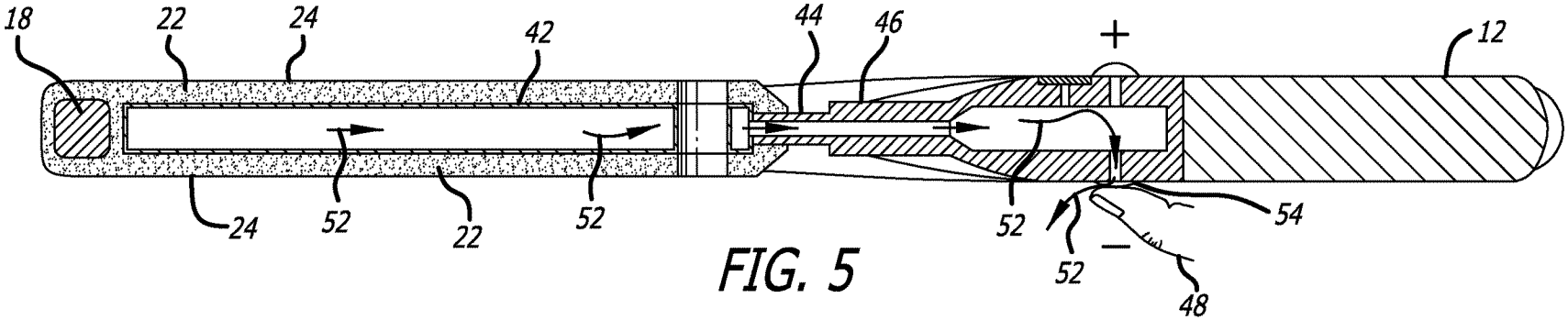
FIG. 5 is a cross sectional view along lines 4-4 of the embodiment of FIG. 1 showing deflation of the bladder.
Figure 6:
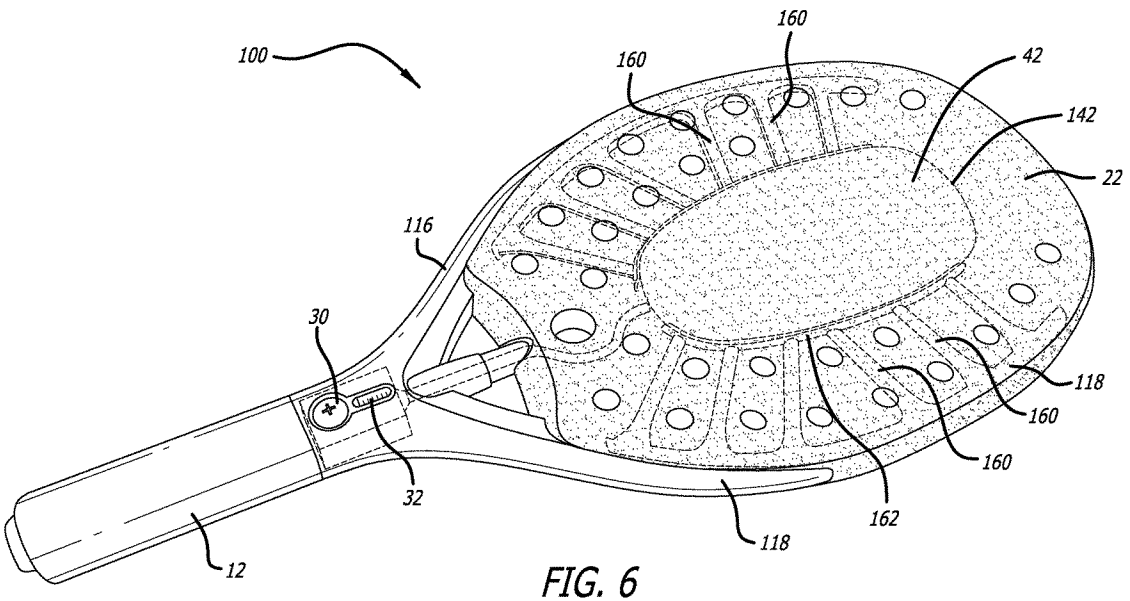
FIG. 6 is an elevated, perspective view of an alternate embodiment of the present invention.

The internal compartment 40 is connected to a bladder 42 by a flexible tubing 44 that passes through the neck portion 18 of the paddle 10. The tubing 44 may be protected by a column 46 of a more rigid material to prevent damage or disconnection of the tubing 44. As shown in FIGS. 4 and 5, the compartment 40 is in fluid communication with the bladder 42 via the flexible tubing 44. The bellows 30 is depressed by a finger 48, which is preferably connected to the compartment with a one-way valve (not shown) to add air pressure to the compartment 40. With each depression of the bellows 30 by the finger 48, the air pressure increases as reflected in the sight glass 32 or other pressure indicator. The increased air pressure in the compartment 40 also increases the air pressure in the connected bladder 42 as indicated by arrows 50, increasing the firmness of the bladder within the insert 22. As the pressure in the bladder 42 increases, the stiffness of the hitting surfaces increases, thereby increasing the COR of the paddle 10.

As shown in FIG. 5, the air pressure can also be reduced in the bladder 42 via valve 54. When the valve 54 is opened, the air in the compartment 40 escapes through the valve, and in turn reduces the air pressure in the connected bladder 42 as indicated by arrows 52. By selectively activating the valve 54 and the bellows 30, the player can adjust the stiffness of the striking surfaces 24 of the paddle 10 by controlling the air pressure in the adjacent bladder 42.

Figure 7:
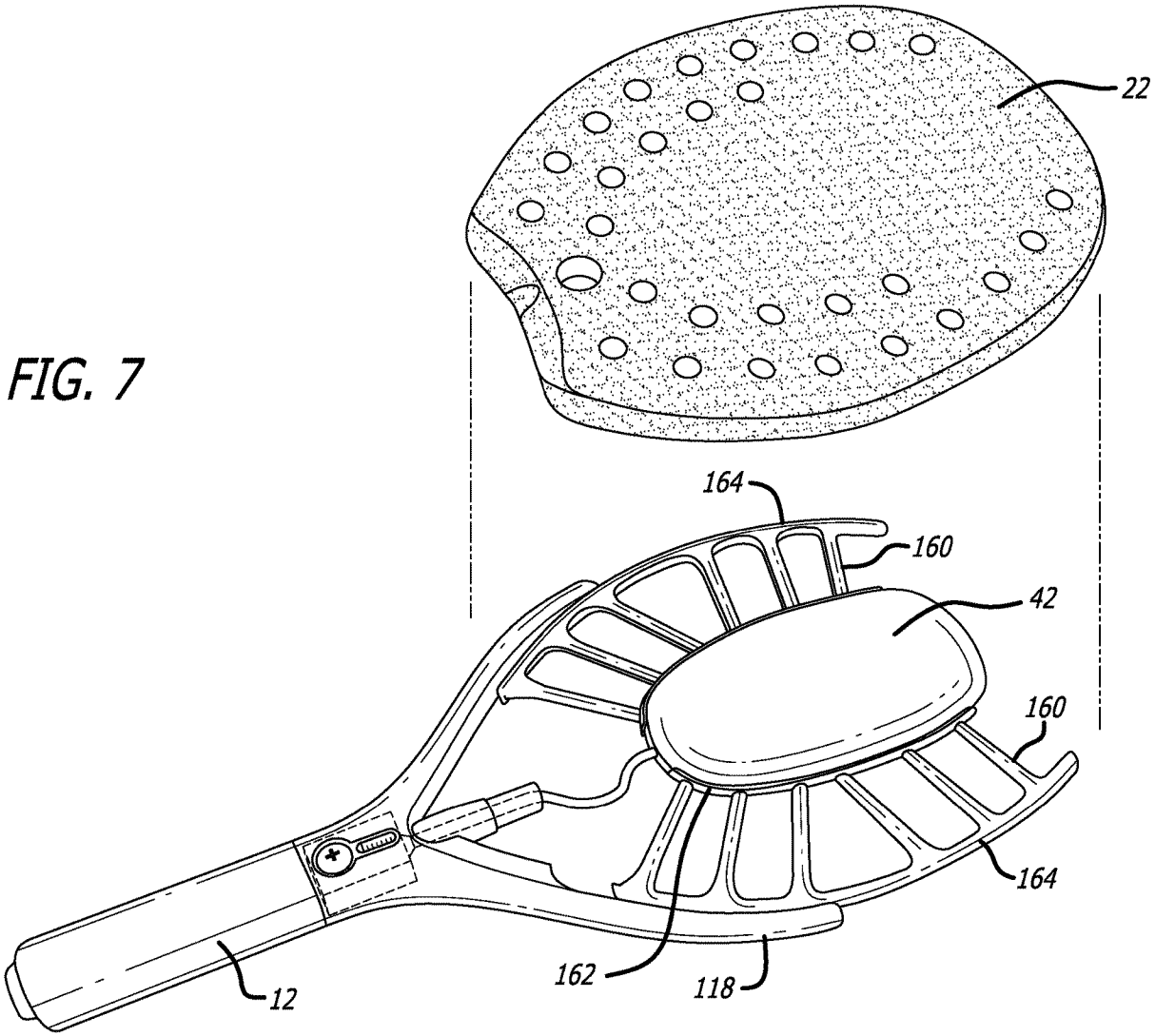
FIG. 7 is an exploded view of the embodiment of FIG. 6.
Figure 8:
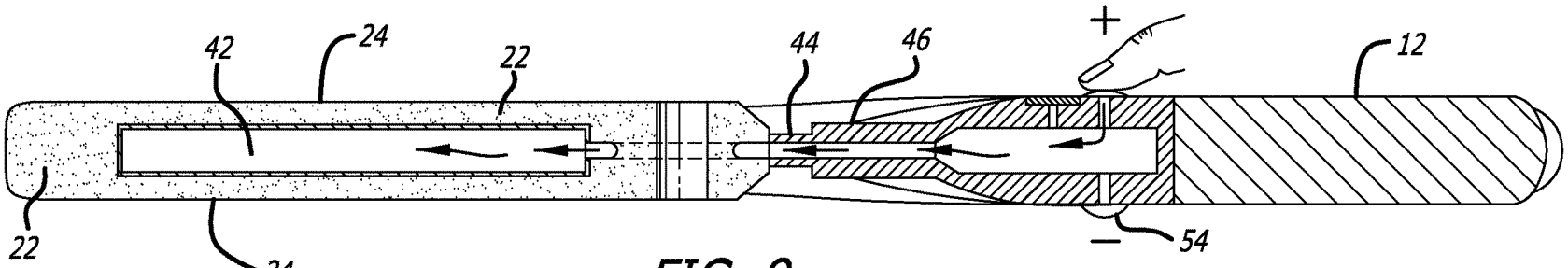
FIG. 8 is a cross sectional view of the embodiment of FIG. 6 showing inflation of the bladder.
Figure 9:
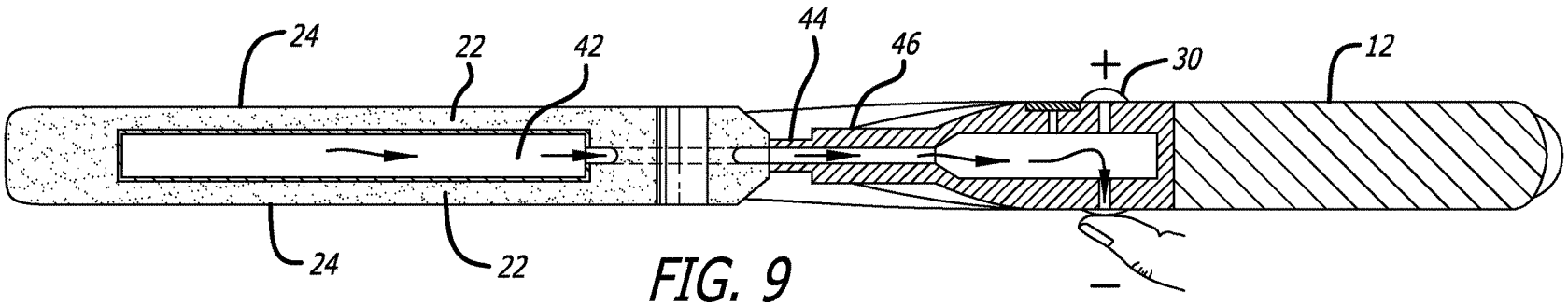
FIG. 9 is a cross sectional view of the embodiment of FIG. 6 showing deflation of the bladder.
Figure 10:
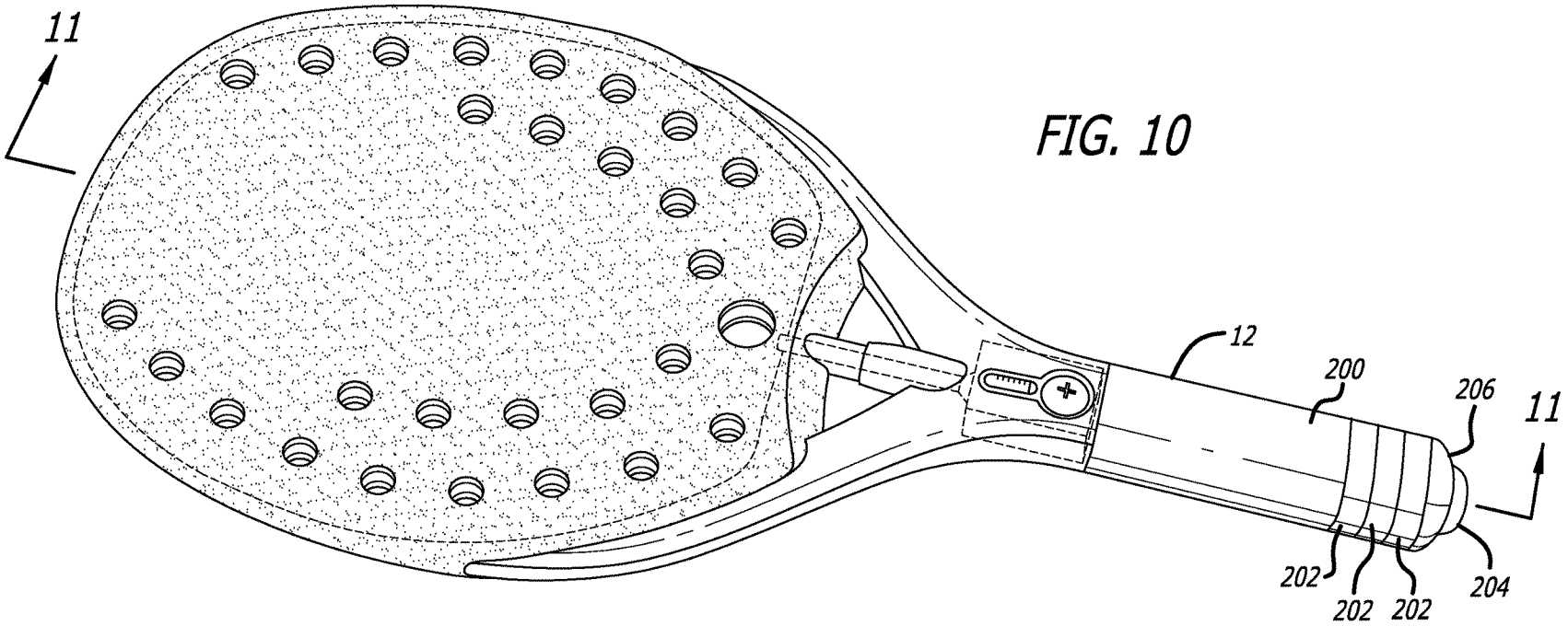
FIG. 10 is an elevated, perspective view of an alternate embodiment of the present invention with an adjustable handle.

FIGS. 6-9 illustrate an alternative embodiment 100 of the paddle of the present invention. In the alternate embodiment, the support structure 116 includes a frame 118 that extends substantially but not completely around the hitting area. The bladder 142 is connected to the handle 12 in a similar manner as in the previous embodiment, but the support structure 116 further includes a plurality of radially extending members 160 that connect the frame 118 to a ring or U-shaped beam 162 that encloses the bladder 42. The radial members 160 can also terminate at a peripheral rim 164, and the beam 162, radial members 160, and peripheral rims 164 can be molded as a single piece support unit (FIG. 7). The radial members 160 in combination with the rims 164 and beam 162 add rigidity to the paddle, although the thickness and material selected can alter the weight and flexure characteristics of the paddle 100 as well.

Figure 11:
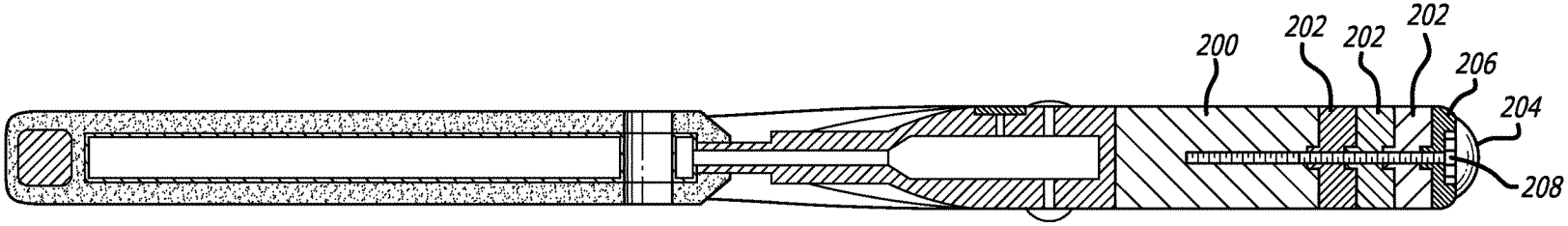
FIG. 11 is a cross sectional view along lines 11-11 showing the embodiment of FIG. 10 with the extendable handle.
Figure 13:
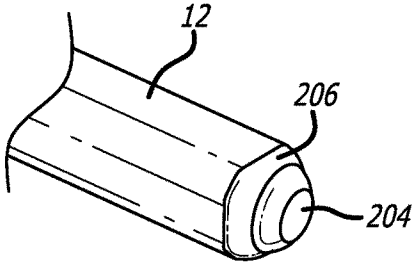
FIG. 13 is an enlarged, perspective view of the end of the handle.
Figure 12:
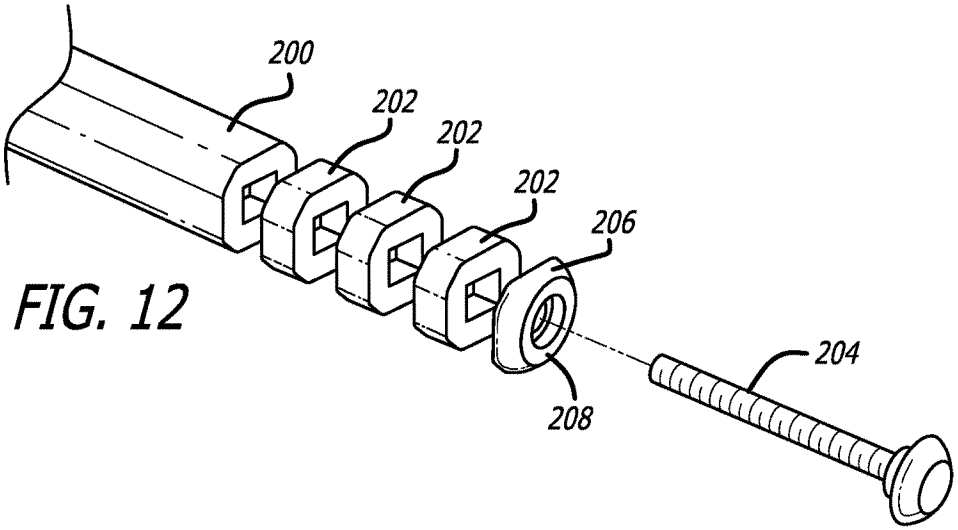
FIG. 12 is an enlarged, elevated exploded view of the end of the handle of FIG. 10.
Figure 14:
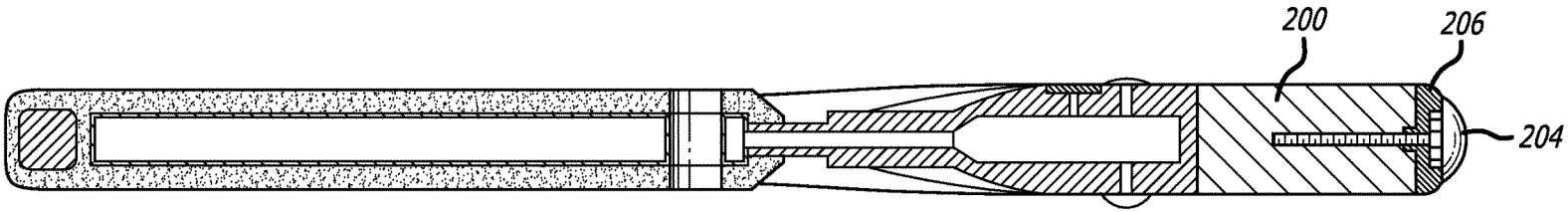
FIG. 14 is a cross sectional view of the shortened handle of FIG. 10.

FIGS. 10-14 illustrate a second preferred embodiment of the present invention. In this embodiment, the handle 12 is made up of a base 200 and a plurality of stackable elements that can be combined at the end of the base 200 to increase the length of the handle 12. The stackable elements are relatively thin concentric blocks 202 that cooperate to extend the length of the handle 12. A threaded fastener 204 is placed in an end cap 206 that engages the distal block to collapse the configuration and create a sturdy, rigid extension. The fastener 204 can thread into the base 200, which can accommodate the fastener 204 regardless of how many blocks 202 (e.g., 0-4) are present. A washer 208 can be used between the fastener 204 and the end cap 206 or recessed into the end cap. The blocks 202 can be of different densities or weights to create a different feel to the paddle depending upon the player and the use. Thus, the blocks 202 can be cork, wood, aluminum, plastic, rubber, or any suitable material that is both durable and can be readily shaped to form a handle segment. FIG. 11 shows the handle 12 in the fully extended, maximum length configuration while FIG. 14 shows the handle in the shortened configuration. Removing the fastener 204 and then the blocks 202 and then replacing the fastener allows the switch back and forth between the two arrangements, while intermediate lengths can also be formed. Note that a protective covering (not shown) can be placed over the handle 12 to cover the blocks 202 and provide a more smooth, tacky feel to the handle 12.

The paddle of the present invention is adaptable to many different sports and activities, and has the advantage of being light weight, easily constructed, modular, and versatile. While various embodiments have been described and depicted, the invention is not limited to those depictions and descriptions. One of ordinary skill in the art would readily recognized certain modifications and substitutions to the foregoing described embodiments, and the invention is intended to include all such modifications and substitutions. Accordingly, the scope of the present invention is properly governed by the appended claims, given their ordinary and customary meanings, read in context of the descriptions and figures herein.

I claim:

1. An adjustable sports paddle, comprising:
- a handle;
- a neck portion;
- a substantially ovular frame;
- first and second striking surfaces mounted in the substantially ovular frame;
- a bladder disposed between the first and second striking surfaces;
- a conduit extending from the bladder to the handle through the neck;
- a pressurizing mechanism in the handle for increasing an air pressure in the bladder via the conduit;
- a depressurizing mechanism in the handle for decreasing the air pressure in the bladder via the conduit; and
- further comprising radial support members extending from the bladder to the ovular frame.

2. The adjustable sports paddle of claim 1, wherein the pressurizing mechanism is a manually operated pump disposed on a first surface of the handle.

3. The adjustable sports paddle of claim 2, wherein the depressurizing mechanism is a relief valve disposed on a second surface of the handle.

4. The adjustable sports paddle of claim 1, further comprising a visual indicator for evaluating a pressure in the bladder.

5. The adjustable sports paddle of claim 4, wherein the visual indicator is located in the handle.

6. The adjustable sports paddle of claim 5, wherein the visual indicator displays a maximum and current air pressure in the bladder.

7. The adjustable sports paddle of claim 1, wherein the conduit is flexible and protected by a rigid tubular column extending through the neck portion.

8. The adjustable sports paddle of claim 1, wherein the first striking surface include holes that align with holes in the second striking surface to permit air to pass through the adjustable sports paddle.

9. The adjustable sports paddle of claim 1, wherein the ovular frame is wishbone shaped.

10. The adjustable sports paddle of claim 1, wherein the pressurizing mechanism is disposed on an opposite side of the handle from the depressurizing mechanism, the adjustable sports paddle being otherwise symmetric with respect to the first and second striking surfaces.

11. The adjustable sports paddle of claim 1, wherein the handle of the paddle is comprised of interlocking members that can be removed to shorten the length of the handle.

12. The adjustable sports paddle of claim 11, wherein the interlocking members include an end cap that compresses the interlocking members using a fastener passing through the interlocking members.

13. The adjustable sports paddle of claim 12, where the fastener mates with a portion of the handle adjacent the interlocking members.

14. The adjustable sports paddle of claim 11, wherein the interlocking members are made of more than one material.

* * * * *